US006889479B2

(12) United States Patent
Thorpe

(10) Patent No.: US 6,889,479 B2
(45) Date of Patent: May 10, 2005

(54) BUILDING BLOCK

(76) Inventor: Douglas G. Thorpe, 101 River Dr., Irvine, KY (US) 40336

( * ) Notice: Subject to any disclaimer, the term of this patent is extended or adjusted under 35 U.S.C. 154(b) by 0 days.

(21) Appl. No.: 10/424,062

(22) Filed: Apr. 28, 2003

(65) Prior Publication Data

US 2004/0221538 A1 Nov. 11, 2004

(51) Int. Cl.[7] ..... E04C 2/04

(52) U.S. Cl. ..... 52/596; 52/605; D25/114; D25/118

(58) Field of Search ..... 52/596, 603–605, 52/607, 591.5, 592.5; 446/128, 110; D25/113, D25/114, 118

(56) References Cited

U.S. PATENT DOCUMENTS

| | | | | | |
|---|---|---|---|---|---|
| 541,815 | A | * | 6/1895 | Lee Sr. | 52/604 |
| 659,602 | A | * | 10/1900 | Bredel | 165/165 |
| 738,643 | A | * | 9/1903 | Van Camp | 52/284 |
| 776,441 | A | * | 11/1904 | Veyon | 52/307 |
| 1,495,022 | A | * | 5/1924 | Langer | 52/293.2 |
| 1,567,085 | A | * | 12/1925 | Rowland | 52/605 |
| 1,568,155 | A | | 1/1926 | Heath | |
| 1,751,272 | A | * | 3/1930 | Forman | 52/314 |
| 1,785,790 | A | | 12/1930 | Ropp | |
| 1,933,600 | A | | 11/1933 | Sanford | |
| 2,055,260 | A | * | 9/1936 | O'Brien | 52/59 |
| 2,145,113 | A | * | 1/1939 | Fulcher | 52/603 |
| 3,936,987 | A | * | 2/1976 | Calvin | 52/309.1 |
| 4,110,949 | A | * | 9/1978 | Cambiuzzi et al. | 52/437 |
| 4,193,241 | A | * | 3/1980 | Jensen et al. | 52/405.4 |
| 4,206,577 | A | | 6/1980 | Moriez et al. | |
| 4,731,279 | A | | 3/1988 | Isshiki | |
| 5,457,926 | A | | 10/1995 | Jensen | |
| 5,471,808 | A | | 12/1995 | De Pieri et al. | |
| 5,701,710 | A | | 12/1997 | Tremelling | |
| 5,960,604 | A | | 10/1999 | Blanton | |
| 6,161,357 | A | | 12/2000 | Altemus | |

* cited by examiner

*Primary Examiner*—Korie Chan
(74) *Attorney, Agent, or Firm*—Clyde I. Cougheneur

(57) ABSTRACT

Molded composite polymer construction blocks are made that are easily assembled, using alinement pins and apertures, with channels for insertion of sealant and vertical passageways for pipes, wires, etc. Stud supporting cavities in one side of the block extend into the ribs or end walls. The cavities can be provided with a protective metal insert. Studs or wooden blocks can be inserted into the cavities. The wooden studs or wooden blocks of various lengths provide spacing for insulation and/or drywall installation.

24 Claims, 4 Drawing Sheets

BUILDING BLOCK

BACKGROUND OF THE INVENTION

1. Field of the Invention

A building block can be made of a polymer and includes alinement pins and apertures for stack formation, a channel, for non-binding sealant, a cavity that can be metal reinforced, for studs or wood used as spacers for insulation and/or supporting dry wall, and central passageways, for routing pipes, wires, etc.

2. Description of Related Art

The building block art is a crowded art with many hundreds of patents. Various alinement means and materials and securing means are disclosed. F. Heath, U.S. Pat. No. 1,568,155, issued Jan. 5, 1926, and F. Ropp, U.S. Pat. No. 1,785,790, issued Dec. 23, 1930, are examples of metal supports for beams or joists. T. Isshiki, U.S. Pat. No. 4,731,279, issued Mar. 15, 1988 and T. Tremelling U.S. Pat. No. 5,701,710, issued Dec. 30, 1997, teach projections and hole alinement with central vertical openings, and T. Isshiki also uses foam as a construction material. C. Sanford, U.S. Pat. No. 1,933,600, issued Nov. 7, 1933, provides "pockets" in the side walls of blocks for securing joists in place. Moriez et al, U.S. Pat. No. 4,206,577, issued Jun. 10, 1980, provides for block alinement and a drywall support without mortar. De Pieri et al, U.S. Pat. No. 5,471,808, issued Dec. 5, 1995 teaches a block having a decorative surface, with alinement means, adhesive bonding means, and vertical passage. C. Blanton, U.S. Pat. No. 5,960,604, issued Oct. 5, 1999, teaches alinement, adhesive caulk used for securing and as a gasket means, and vertical passages. A. Altemus, U.S. Pat. No. 6,161,357, issued Dec. 19, 2000, teaches vertical passages, alinement grooves and interlocking blocks. D. Jensen, U.S. Pat. No. 5,457,926, issued Oct. 17, 1995, teaches foam blocks that interlock using grooves and tongues and that have internal passages.

SUMMARY OF THE INVENTION

A waterproof building block is formed by molding a composite polymer concrete, such as Quazite™, so as to have alinement pins and apertures on the upper and lower surfaces. Horizontal and vertical channels are provided in the block for reception of a sealer. Internal vertical openings provide for passage of pipes, wires, HVAC tubes, etc. A central cavity is provided in one side of the block and extends into the block central rib or end walls. A vertical central rib can be provided with a protective metal insert for reception of a removable stud or a wooden block that can be used to form a spacing for insulation and/or dry wall attachment. A composite polymer concrete is composed of a fiber reinforced polymer composite material using a resin binder, aggregate and possible fillers.

DESCRIPTION OF THE PREFERRED EMBODIMENTS

A waterproof building block is provided that can be manufactured from resin binder, chopped glass fibers, and open graded aggregate of less than ¾". The block is preferably composed of a cast polymer base fiberglass reinforced block with steel alinement pins and a cavity into which a wooded stud can be inserted for fabricating a wooded framed wall. The block can be colored and formed with decorative coverings to resemble siding, brick, stucco, etc. The lightweight blocks are strong enough to compete with conventional concrete blocks and can be assembled and disassembled and recycled easily, as no mortar or permanent joining means are necessary.

The construction block can be formed with one unfinished side and three finished sides for use as a decorative covering, eliminating the need for decorations and mortar. It can be used as a load bearing wall framework to support dry wall or sheet rock, etc. When the blocks are alined, unobstructed inside passages through the blocks provide for running electrical conduits, utility piping, etc.

Figure 1:
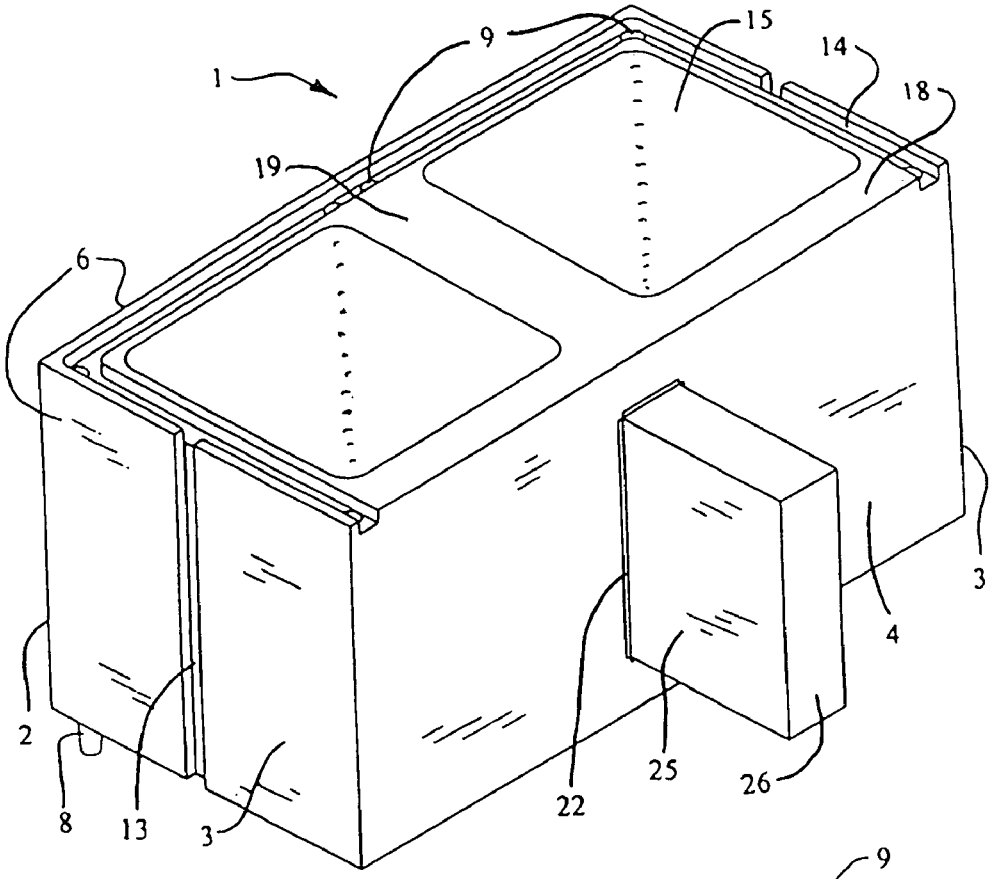
FIG. 1 is a perspective view of a building block of the invention.
Figure 2:
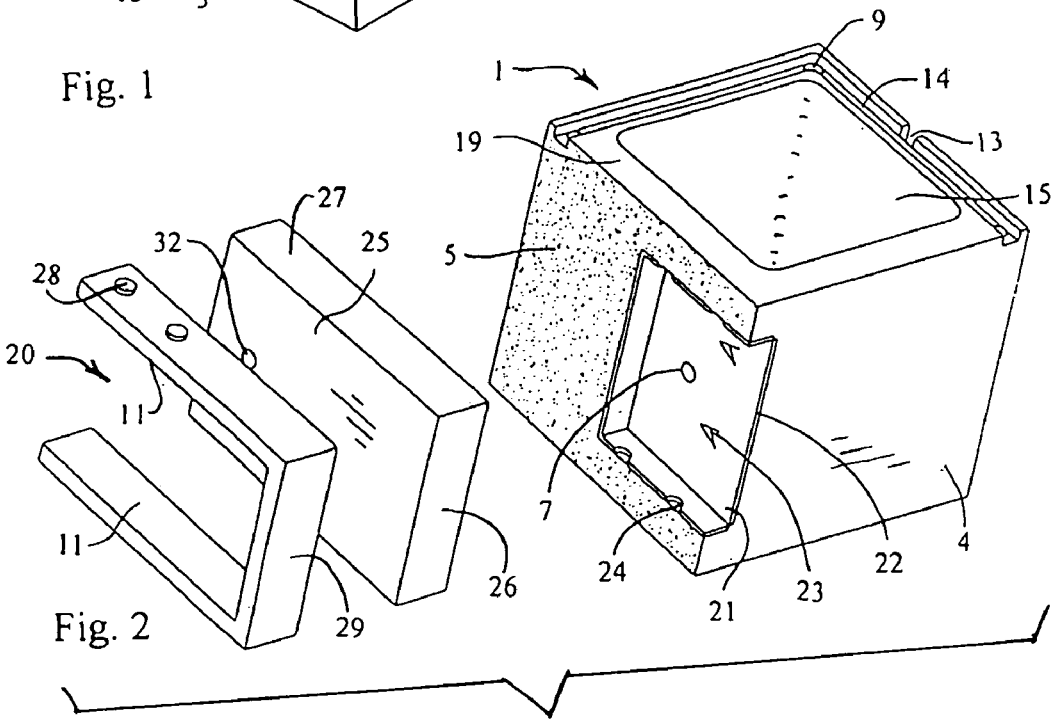
FIG. 2 is a perspective exploded view of the building block of FIG. 1 with a section broken away.

As seen in FIGS. 1 and 2, the building block 1 can be constructed from a fiber reinforced polymer composite using resins and aggregate 5. The blocks have a finished front wall 2, unfinished back wall 4, and finished end walls 3 and a central rib 19. The blocks contain vertical 13 and horizontal 14 channels for the introduction of a non-binding sealant that will permit ease of recycling when the blocks are disassembled. The horizontal channel extends around the upper surface along the ends and front of the upper surface. The seals waterproof the wall the blocks are used to construct. Plural steel or plastic alinement pins 8 and matching apertures 9 are provided, preferably in the channels, so that the blocks can be accurately placed on each other by even a novice in the art. The pins and apertures provide the means for both rapid assembly and rapid disassembly. With the blocks in alinement one layer over the other, open passages 15, essentially in vertical alinement with each other, whether staggered or not, provide a passage for equipment such as pipes, wires, HVAC, etc. The outer vertical surfaces can be finished 6 or unfinished 4. The finished surfaces can be textured by various designs in molding plates. The outer walls 18 and central rib 19 define the open passages 15. A vertically elongated central recess or locking cavity 21 is made through the unfinished side and into the wide central rib 19. The cavity 21 is narrower than the width of the central rib 19, and extends within the central rib without communication with the open passages 15. The inner surfaces of the central recess 21 are spaced from the upper surface and from the lower surface to provide support and can be covered by a metallic insert 22. The metal insert is preferably bonded into the block by a resin binder and interlocking spikes 23. The metallic insert distributes forces to the building block side and central rib synthetic material to preclude wear and tear due to localized forces that could easily damage the synthetic material. The metallic insert 22 is provided with interlocking spikes 23, punched out from the insert, and removable stud mounting holes 24, formed in the insert. The metallic insert is the recipient of a spacing member in the form of either a wooden block 25 or a plastic or metal removable preformed stud insert 20. The wooden block 25 has an upper surface 27 and end surface 26. The removable stud 20 is in the shape of a "U" with a base 29 and legs 11 extending out from the base. The legs of the removable stud are provided with protrusions 28. The removable studs can be held in the metallic insert 22 by having the protrusions 28 inserted into the stud mounting holes 24. The wooden block 25 can be held within the metallic insert 22 by having the wooden block impaled by the interlocking spikes 23. By choosing the appropriate length wooden block 25, any desired thickness of insulation can be placed between drywall, or other finishing material attached to or abutting against the outer ends 26 of the wooden blocks or the stud inserts, and the blocks. The wooden blocks 25 can be secured in the central rib 19 by providing a pin hole 7 through the central rib 19 and metallic insert 22 and a pin hole 32 in the wooden block 25 for placement of a retainer pin. Depending on the strength of the construction material 5, there may be no need for the metallic insert 22.

Figure 3:
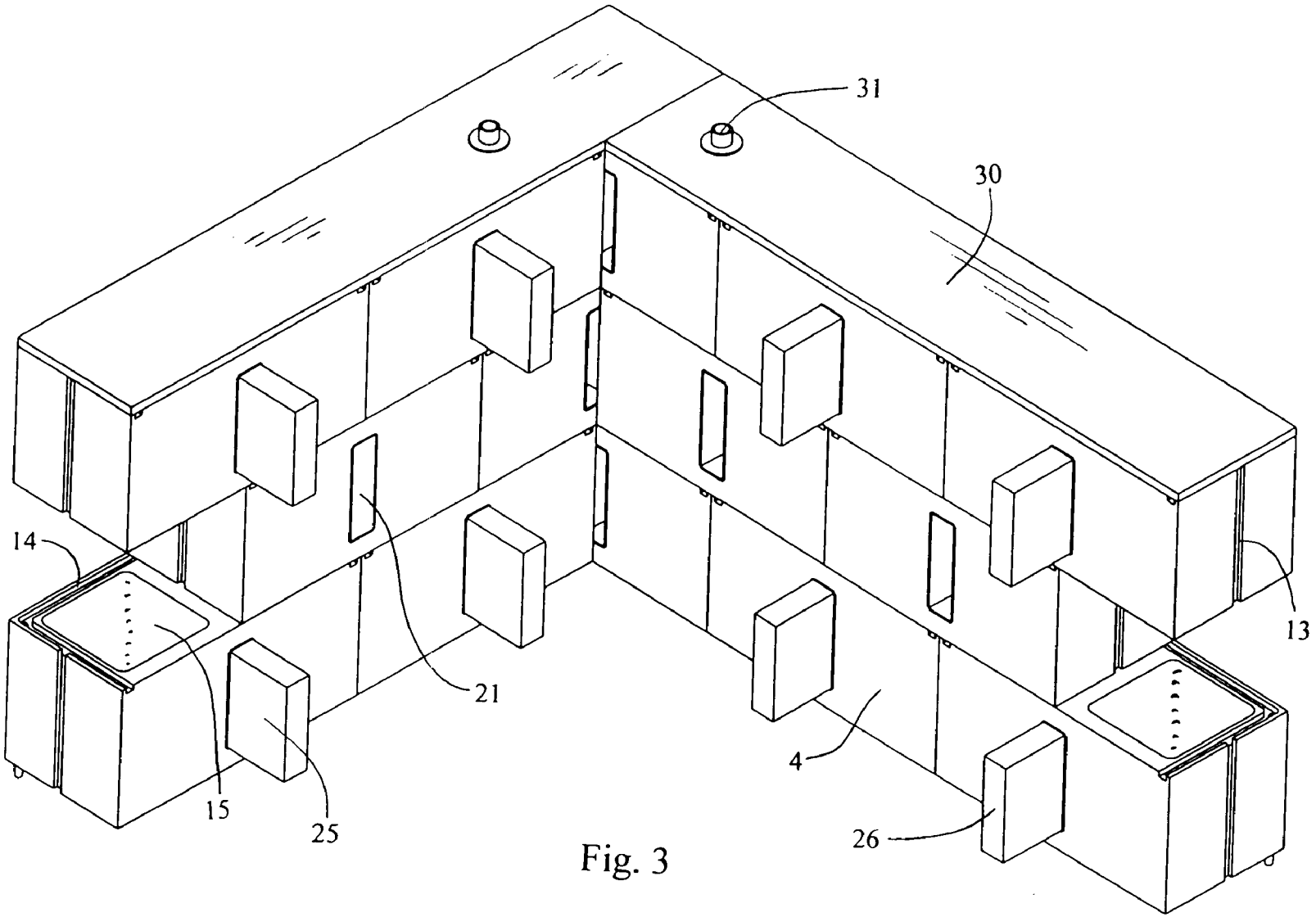
FIG. 3 is a perspective view of a wall section constructed with the building blocks of FIG. 1.

FIG. 3 depicts building blocks assembled into a three tier wall. The bottom and top tiers show wooden blocks 25 inserted into the locking cavities 21 on the unfinished face 4 of the blocks. A tie down bolt 31 passes through plates 30 and passages 15 in the blocks to secure the wall in place. The wooden blocks provide a space between the block face 4 and the wooden block end surface 26 that can be used to position insulation between the blocks and a dry wall secured to or spaced by the end surfaces of the wooden blocks.

Figure 4:
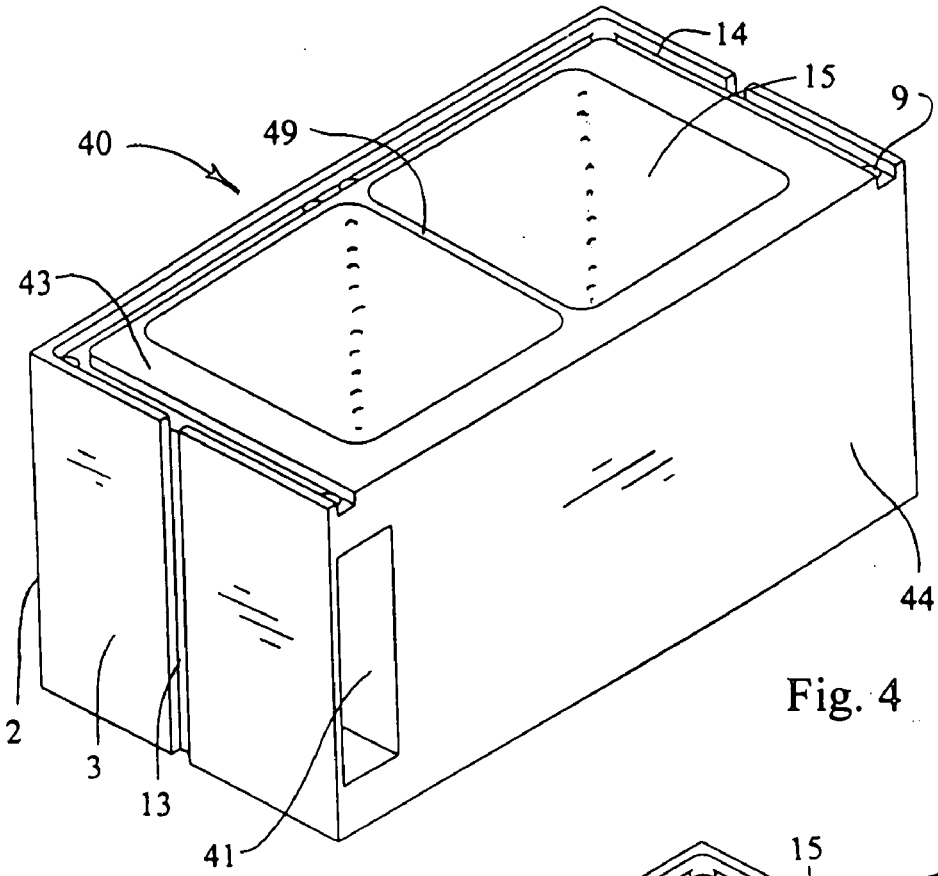
FIG. 4 is a perspective view of a first modification of the building block shown in FIG. 1.

The block 40 shown in FIG. 4 is similar to that shown in FIG. 1 with the recess or cavity 41 placed in a wide end wall 43. The same front wall 2, end walls 3, vertical 13 and horizontal 14 channels and open passages 15 are present. The unfinished back wall 44 accommodates the cavity 41 with a thin central rib 49.

Figure 5:
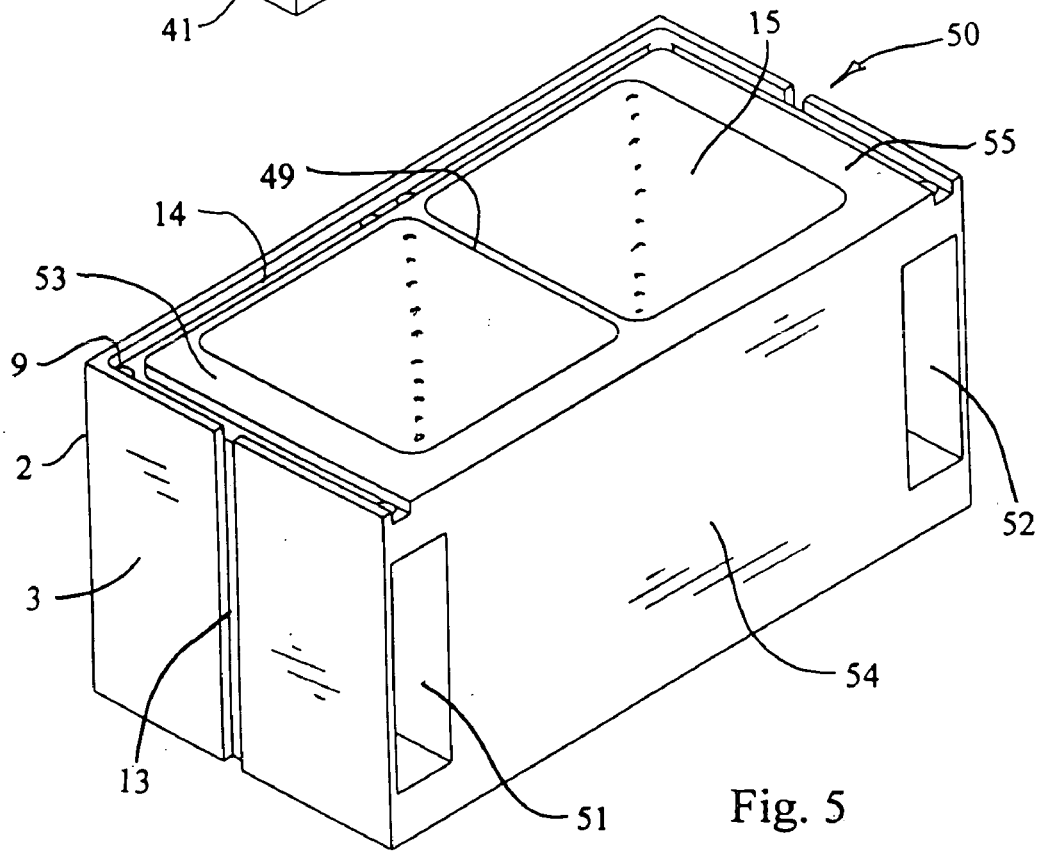
FIG. 5 is a perspective view of a second modification of the building block shown in FIG. 1.

The block 50 shown in FIG. 5 is similar to that shown in FIG. 4 with two cavities 51,52 placed in wide end walls 53,55. The cavities 51,52 are formed in the unfinished back wall 54. The same end walls 3, front wall 2, vertical 13 and horizontal 14 channels, and open passages 15 are present. The central rib 49, as in FIG. 4, is provided.

Figure 6:
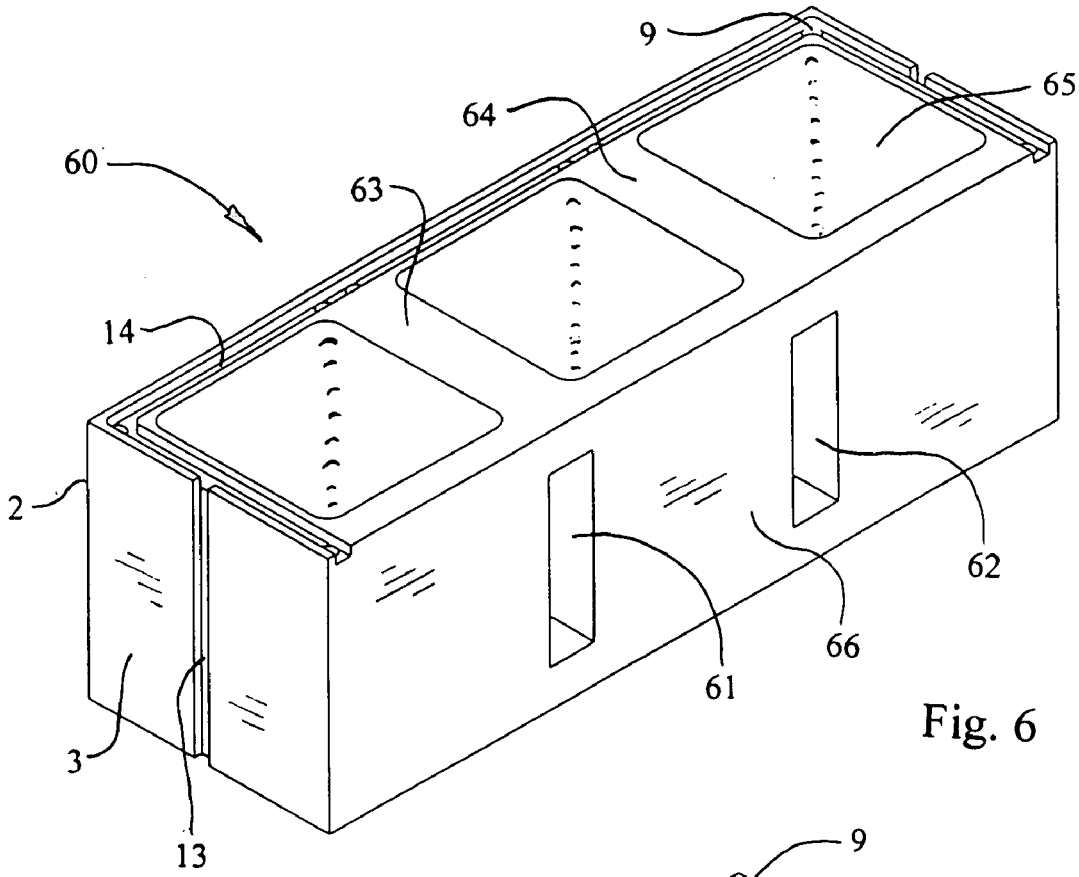
FIG. 6 is a prospective view of a third modification of the building block shown in FIG. 1

The block 60 shown in FIG. 6 is similar to that shown in FIG. 1 but is provided with two wide central ribs 63,64 and three open passages 65. The wide central ribs 63,64 each house a cavity 61,62 formed in the unfinished back wall 66. The block 60 is provided with the same front wall 2, end walls 3, vertical 13 and horizontal 14 channels. As with the other cavities, the wide end walls and/or wide central ribs surround the cavities to secure the wooden or other blocks securely in place.

Figure 7:
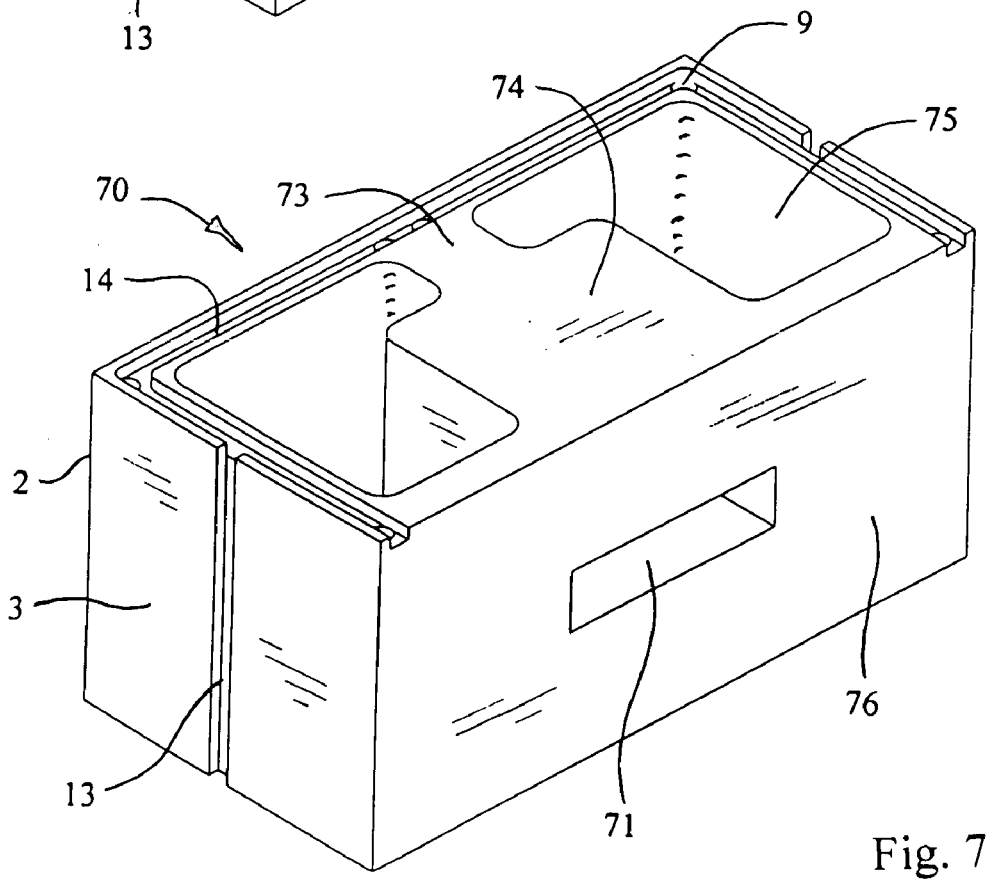
FIG. 7 is a perspective view of a fourth modification of the building block shown in FIG. 1.

The block 70 shown in FIG. 7 has the same end walls 3, front wall 2, vertical 13 and horizontal 14 channels as in FIG. 1. The central section of the block has a wide rib 73 at the front that expands in width and depth 74 until it can accommodate a cavity 71 that has a horizontal elongated width for receiving a wooden block 25 in the back wall 76. The cavity 71 can be made in the unfinished back wall at any desired angle.

It is believed that the construction, operation and advantages of this invention will be apparent to those skilled in the art. It is to be understood that the present disclosure is illustrative only and that changes, variations, substitutions, modifications and equivalents will be readily apparent to one skilled in the art and that such may be made without departing from the spirit of the invention as defined by the following claims.

What is claimed is:

1. A building block comprising:

a molded material forming a front wall, a back wall, end walls, a central rib, an upper surface and a lower surface;

a cavity in said back wall extending into said molded material of said block below said upper surface and above said lower surface and between said end walls;

a metal insert secured within said cavity for securing a spacing member therein;

said metal insert having interlocking spikes and mounting holes.

2. A building block as in claim 1 including:

a spacing member;

said spacing member is a non-wooden stud in the shape of a "U" having a base with two legs;

said non-wooden stud has protrusions on its legs for engagement in said mounting holes.

3. A building block as in claim 1 including:

a spacing member;

said spacing member is a wooden block secured within said metal insert by said interlocking spikes.

4. A building block as in claim 1 including:

a channel extending along said block upper surface and along said block end walls for reception of a sealant;

alinement pins in said block lower surface and corresponding alinement apertures in said block upper surface.

5. A building block as in claim 4 including:

a spacing member;

said spacing member is a non-wooden stud in the shape of a "U" having a base with two legs;

said non-wooden stud has protrusions on its legs for engagement in said mounting holes.

6. A building block as in claim 4 including:

a spacing member;

said spacing member is a wooden block secured within said metal insert by said interlocking spikes.

7. A building block as in claim 1 wherein:

said molded material forming said building block is a fiber reinforced polymer composite.

8. A building block comprising:

a molded material forming a front wall, a back wall, end walls, a central rib, an upper surface and a lower surface;

a cavity in said back wall extending into said molded material of said block below said upper surface and above said lower surface and between said end walls;

a metal insert secured within said cavity for securing a spacing member therein;

alinement pins in said block lower surface and corresponding alinement apertures in said block upper surface.

9. A building block as in claim 8 including:

a spacing member;

said spacing member is a non-wooden stud in the shape of a "U" having a base with two legs.

10. A building block as in claim 8 including:

a channel extending along said block upper surface and along said block end walls for reception of a sealant.

11. A building block as in claim 8 wherein:

said molded material forming said building block is a fiber reinforced polymer composite.

12. A building block as in claim 8 including:

a spacing member;

said spacing member is a wooden block secured within said metal insert.

13. A building block comprising:

a molded material forming a front wall, a back wall, end walls each having an outside surface, a central rib, an upper surface and a lower surface;

a cavity in said back wall extending into said molded material of said block below said upper surface and above said lower surface and between outer surface of each of said end walls;

a channel extending along said block upper surface and along said block end walls for reception of a sealant;

alinement pins in said block lower surface and corresponding alinement apertures in said block upper surface.

14. A building block as in claim 13 wherein:

said central rib divides said block interior into two open passages that can be alined with similar passages in other building block to accommodate equipment passage;

said cavity is narrower than said central rib and extends within said central rib.

15. A building block as in claim 14 including:

a pin hole in said central rib extending into said cavity for passage of a pin to secure an element in said cavity.

16. A building block as in claim 13 wherein:

said cavity is narrower than said end walls and extends within one of said end walls.

17. A building block as in claim 16 wherein:

a second cavity extends into the other one of said end walls;

said cavities are narrower than said end walls and extend within said end walls.

18. A building block as in claim 13 wherein:

said molded material forms a second central rib dividing said block interior into three open passages that can be alined with similar open passages in other building block to accommodate equipment passage;

and a second cavity extends into each second central rib;

said cavities are narrower than said central ribs and extend within said central ribs.

19. A building block as in claim 13 wherein:

said central rib divides said block interior into two open passages that can be alined with similar open passages in other building block to accommodate equipment passage;

said central rib having sufficient width and depth so that it can accommodate a cavity at any desired angle within said central rib.

20. A building block as in claim 13 wherein:

said alinement apertures are positioned within said channel extending along said block upper surface.

21. A building block as in claim 13 including:

said cavity in said back wall extending into said molded material of said block above said lower surface and below said upper surface and between said end walls accommodates the reception of a spacing member.

22. A building block as in claim 21 including:

a metal insert secured within said cavity for securing the spacing member therein and dissipating forces to said molded material.

23. A building block as in claim 22 including:

said metal insert having interlocking spikes and mounting holes.

24. A building block as in claim 13 including:

said cavity extending into said central rib;

a pin hole through said central rib passing into said cavity for securing a spacing member therein by insertion of a pin.

* * * * *